US006127902A

United States Patent [19]

Speldrich et al.

[11] Patent Number: 6,127,902

[45] Date of Patent: Oct. 3, 2000

[54] WAVEGUIDE DIRECTIONAL COUPLER CAPABLE OF PROPAGATING HIGHER ORDER MODES

[75] Inventors: Werner Speldrich; Uwe Rosenberg, both of Backnang, Germany

[73] Assignee: Robert Bosch GmbH, Stuttgart, Germany

[21] Appl. No.: 09/057,193

[22] Filed: Apr. 8, 1998

[30] Foreign Application Priority Data

Apr. 18, 1997 [DE] Germany ..... 197 16 290

[51] Int. Cl.[7] ..... H01P 5/18

[52] U.S. Cl. ..... 333/113; 333/248

[58] Field of Search ..... 333/113, 114, 333/248

[56] References Cited

U.S. PATENT DOCUMENTS 2,739,287 3/1956 Riblet ..... 333/113
2,876,421 3/1959 Riblet ..... 333/113 X
3,044,026 7/1962 Patterson ..... 333/113
3,614,672 10/1971 Newbould ..... 333/113

FOREIGN PATENT DOCUMENTS 11 26 461 3/1962 Germany .
245102 10/1988 Japan ..... 333/113

*Primary Examiner*—Benny Lee
*Attorney, Agent, or Firm*—Michael J. Striker

[57] ABSTRACT

A simply made and very broad band directional coupler includes a hollow middle section (CS) provided with an empty interaction space having two ends, one pair of hollow guides (H1, H3) coupled to one end of the interaction space, another pair of hollow guides coupled to another end of the interaction space and a coupler diaphragm (KB1, KB2, KB3, KB4) provided between the interaction space (KR) and each individual hollow guide coupled to it. Higher wave types (are consisting of TE11 and TM11 modes) propagated in the interaction space (KR) as well as a fundamental wave type (TE 10). Furthermore a height (h) of the interaction space is at least 2.5 times the smallest height (b) of a coupling diaphragm (KB1, KB2, KB3, KB4) so that a comparatively broad band directional coupler results.

1 Claim, 1 Drawing Sheet

WAVEGUIDE DIRECTIONAL COUPLER CAPABLE OF PROPAGATING HIGHER ORDER MODES

BACKGROUND OF THE INVENTION

The present invention relates to a directional coupler with an interaction space having two ends or sides, at each of which two hollow guides are coupled and in which the interaction space has dimensioned such that the higher wave types TE11 and TM11 modes can be propagated as well as the fundamental wave type TE10 mode.

This type of directional coupler is known from and described in German Published Patent Document 11 26 461. This directional coupler comprises two rectangular hollow guides, which are arranged with wide sides there of adjacent to each other. An opening is provided in the common separating wall of the hollow guides, which forms an interaction space, in which higher wavw mode types, such as TE11 and TM11 modes, can exist as well as the fundamental mode TE10. According to the state of the art the separating wall between the hollow guides must be as thin as possible in order to keep the irregularities at the transition points between the hollow guides and the interaction space very small for extensive reduction of reflections. The directional coupler described in this reference is disadvantageously very narrow band.

SUMMARY OF THE INVENTION

It is an object of the present invention to provide a directional coupler of the above-described type which avoids the above-described disadvantages.

It is another object of the present invention to provide a directional coupler of the above-described type which is comparatively broad band in comparison to the comparatively narrow band coupler of the prior art.

According to the invention the directional coupler includes a hollow middle section provided with an empty interaction space, a first pair of hollow guides coupled to one end of the interaction space, another pair of hollow guides connected to another end of the interaction space and a respective coupler diaphragm between the interaction space and each of the individual hollow guides. The interaction space is dimensioned so that higher wave mode types TE and TM are advantageously consisting of the TE11 and TM11 modes propagated as well as the fundamental TE10 mode and a height (h) of the interaction space is at least to 2.5-times a height (b) of the coupler diaphragms.

The object of the invention is attained by the directional coupler according to the invention because the coupler diaphragms are provided between the interaction space and the individual hollow guides and the height of the interaction space is at least 2.5-times the height of the coupler diaphragms. Because of that aspect of the invention a very broad band matching of the hollow guide to the wave types in the interaction space is obtained. The interaction space with the connecting hollow guides can be very easily made by milling, which is particularly advantageous for applications in the millimeter wave frequency range. Besides the directional coupler is characterized by a very compact structure and it has a very high power handling capability, since very small gaps are not present in the coupled region.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
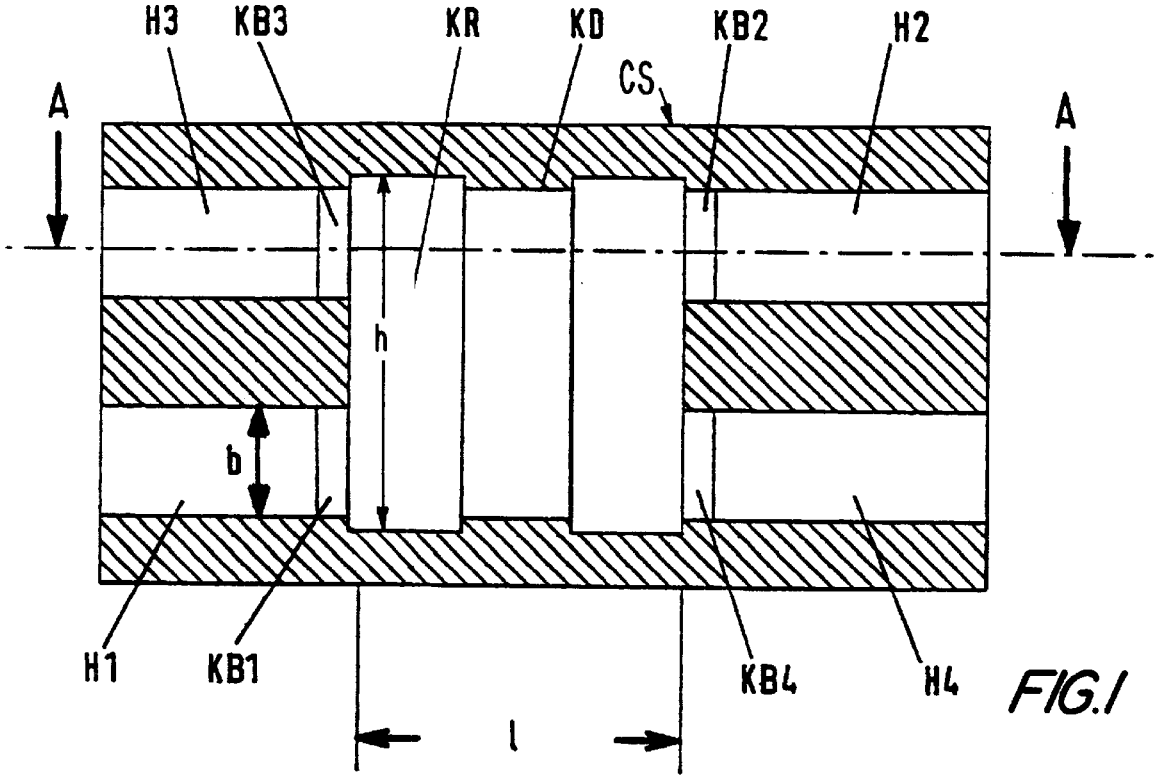
FIG. 1 is a longitudinal cross-sectional view through a directional coupler according to the invention.
Figure 2:
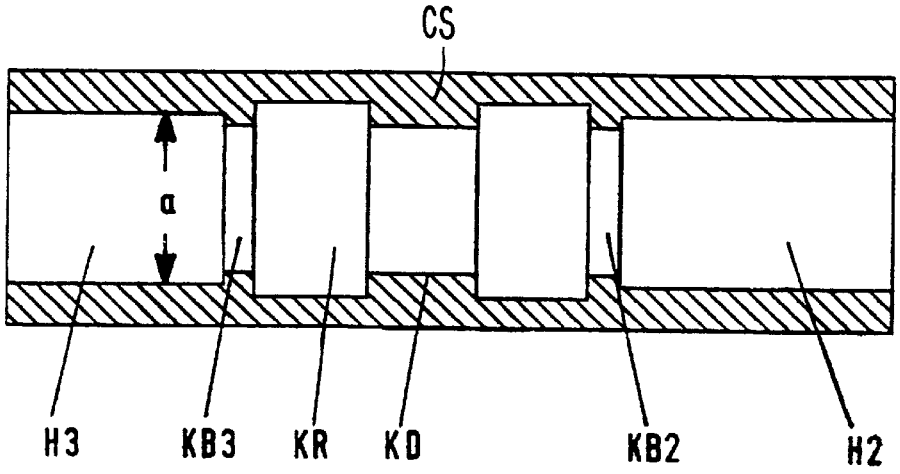
FIG. 2 is a cross-sectional view through the apparatus shown in FIG. 1 taken along the section line A—A in FIG. 1.

A directional coupler KR constructed in hollow guide engineering is shown in two different cross-sectional views in FIGS. 1 and 2. Thus FIG. 1 shows a longitudinal cross-section parallel to the hollow guide small side b and FIG. 2 is a cross-sectional view taken along the section line A—A parallel to the hollow guide wide side a. As best seen in FIG. 1, the directional coupler comprises a hollow middle section CS provided with an empty interaction space KR of length 1, at whose opposite ends respectively two symmetric rectangular hollow guides H1, H3 and H2, H4 are coupled or connected. Each hollow guide H1, H2, H3 and H4 is coupled to the interaction space KR by means of a respective coupler diaphragm KB1, KB2, KB3, KB4. The interaction space KR has a height h which corresponds to at least 2.5 times the coupler diaphragm height b. Because of the selection of dimensions in this way the fundamental mode TE10 and the higher wave types consisting of the TE11 and TM11 modes can be propagated in it.

It should be noted that the hollow guide H1 is the input gate of the directional coupler, in which an electromagnetic wave of type TE10 is input. The energies of these waves should be divided into both hollow guides H2 and H4, however not coupled into the hollow guide H3 (see FIG. 1). This requirement is achieved because the interaction space KR is dimensioned in regard to its width and height h so that on transfer of the waves fed in through the hollow guide H1 into the interaction space KR the higher wave types TE11 and TM11 are excited as well as the fundamental wave type TE10, which then propagates in the interaction space KR in the direction of the hollow guides H2 and H4. The energy of the input waves is divided into equal parts in the fundamental wave TE10 and in the higher wave types TE11 and TM11 in the selection of these wave types. The fundamental wave TE10 contains also an equal sized energy component for both higher wave types TE11 and TM11 together. The energy components of the TE11 and TM11 wave type vary of course in their operating frequency range and are only equal-sized at a discrete frequency, however they add continuously to form a sum equal to half the energy of the input wave. Where the hollow guide H3 opens into the interaction space KR, the overlapping fields due to the TE10 TE11 and TM11 wave types cancel each other, so that no energy is coupled in this hollow guide H3.

The phase difference of the 3-dB signal components of the TE10-fundamental wave type, the TE11-wave type and the TM11 wave type in the branching plane of the hollow guides H2 and H4 is essential for the coupling function. The desired phase difference is set or determined by selection of the cross-section and length 1 of the interaction space KR. Thus different coupling factors (or values) can be obtained by a suitable selection of this parameter.

The coupler diaphragms KB1, KB2, KB3 and KB4 at the transition points between the respective hollow guides H1, H2, H3 and H4 to the interaction space KR shown in FIG. 2 cause a good broad-band match of the fundamental wave types of the hollow guides H1, H2, H3 and H4 to the wave types in the interaction space KR.

For optimization of the transmission behavior of the directional coupler so that it is as broad band as possible in addition one or more discontinuities KD can be provided a cross-section jump is provided in the embodiment shown in FIGS. 1 and 2. Pins can also be provided at suitable locations in the interaction space acting as discontinuities KD for improvement of the return loss and for an optimization of the excitation of different wave types in the interaction space KR.

Another embodiment of the coupler according to the invention is also possible. This other embodiment has diaphragms and hollow waveguides of differing heights and may be used to adapt different interfacing waveguides without the need of additional waveguide transformers. For this purpose it has two different symmetrical pairs of diaphragms, respectively, and hollow waveguides, that differ from those of the previous embodiment shown in FIGS. 1 and 2. If the diaphragms at one interconnecting plane are different, a special design effort must be focused on the decoupling requirements of the two ports. When feeding a signal into one port, the electromagnetic fields in front of the diaphragm at the other port at the interconnecting plane caused by the superposition of the TE10 and TE11/TM11 modes that are excited at the diaphragm in front of the one port must vanish and vice versa.

If the coupler design uses diaphragms of different heights, then the height h of the interaction space is at least 2.5 times the smallest diaphragm height b (see FIG. 1 of the first embodiment).

While the invention has been illustrated and described as embodied in a directional coupler, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A directional coupler comprising a hollow middle section (CS) provided with an empty interaction space (KR) having two ends, a first pair (H1, H3) of hollow guides coupled to one of said two ends of said interaction space (KR), a second pair (H2, H4) of hollow guides coupled to the other of said two ends of said interaction space (KR) and a respective coupler diaphragm (KB1, KB2, KB3, KB4) provided between the interaction space (KR) and each individual one (H1, H2, H3, H4) of said hollow guides;

wherein said interaction space (KR) having dimensions such that higher wave types consisting of TE11 and TM11 modes are propagated therein as well as a fundamental TE10 mode and a height (h) of the interaction space (KR) is at least 2.5-times a smallest height (b) of said coupler diaphragms (KB1, KB2, KB3, KB4).

* * * * *